US007367094B2

(12) United States Patent
Morris

(10) Patent No.: US 7,367,094 B2
(45) Date of Patent: May 6, 2008

(54) APPARATUS FOR IMPARTING STRETCH TO FABRICS

(75) Inventor: Paul A. J. Morris, Leeds (GB)

(73) Assignee: Pro-Fit International Limited, West Yorkshire (GB)

( * ) Notice: Subject to any disclaimer, the term of this patent is extended or adjusted under 35 U.S.C. 154(b) by 0 days.

(21) Appl. No.: 10/580,099

(22) PCT Filed: Oct. 4, 2004

(86) PCT No.: PCT/GB2004/004201

§ 371 (c)(1),
(2), (4) Date: Oct. 27, 2006

(87) PCT Pub. No.: WO2005/033397

PCT Pub. Date: Apr. 14, 2005

(65) Prior Publication Data

US 2007/0089281 A1 Apr. 26, 2007

(30) Foreign Application Priority Data

Oct. 2, 2003 (GB) ..... 0323002.6

(51) Int. Cl.
*D06C 3/00* (2006.01)

(52) U.S. Cl. ..... 28/155; 28/156

(58) Field of Classification Search ..... 26/18.6, 26/18.5; 28/155, 156, 116, 122, 138, 134, 28/157, 165; 264/280, 282, 283, 319, 324
See application file for complete search history.

(56) References Cited

U.S. PATENT DOCUMENTS 2,034,421 A * 3/1936 Rowe et al. ..... 425/370
2,319,809 A * 5/1943 Francis, Jr. ..... 26/18.6
2,335,313 A * 11/1943 Rowe et al. ..... 26/18.6
2,885,763 A * 5/1959 Schreiner ..... 26/18.6
3,188,372 A * 6/1965 Roos ..... 264/287
3,382,553 A * 5/1968 Davis et al. ..... 26/18.6
3,538,563 A * 11/1970 Amemiya et al. ..... 26/18.6
3,691,600 A 9/1972 Joy
4,088,731 A * 5/1978 Groome ..... 264/282
4,888,860 A * 12/1989 Metzen ..... 26/18.6

(Continued)

FOREIGN PATENT DOCUMENTS

DE 4323715 8/1994

(Continued)

OTHER PUBLICATIONS

PCT International Search Report filed Dec. 3, 2004; International Application No. PCT/GB2004/004201.

*Primary Examiner*—A. Vanatta
(74) *Attorney, Agent, or Firm*—Howard & Howard Attorneys, P.C.

(57) ABSTRACT

An apparatus for the treatment of fabric which comprises transport means (20, 26) for effecting relative movement between a heat and pressure application means and the fabric, whereby the passage of the fabric through the apparatus results in the yarns substantially across the width of the fabric being forced closer together, thus imparting semi-permanent "ease" or "stretch" into the fabric, characterised in that fabric speed control means (28) are employed downstream of the apparatus whereby to maintain the fabric output speed at a predetermined level.

11 Claims, 1 Drawing Sheet

U.S. PATENT DOCUMENTS

Figure 2:
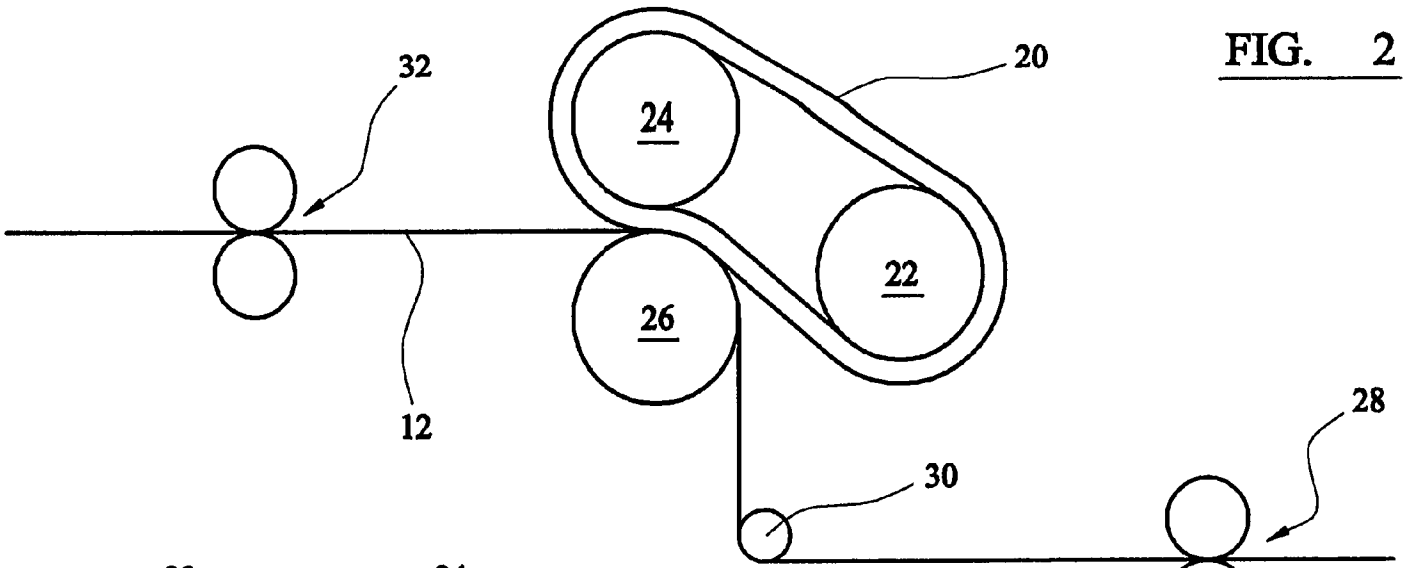

| | | | | | |
|---|---|---|---|---|---|
| 4,908,918 | A * | 3/1990 | Strahm et al. | ..... | 26/18.6 |
| 4,920,621 | A | 5/1990 | Metzen | | |
| 4,969,243 | A * | 11/1990 | Strahm | ..... | 26/18.6 |
| 5,987,721 | A * | 11/1999 | Morris | ..... | 28/155 |
| 6,732,413 | B1 * | 5/2004 | Morris | ..... | 28/156 |

FOREIGN PATENT DOCUMENTS

| | | |
|---|---|---|
| GB | 1507633 | 4/1978 |
| JP | 4073259 | 3/1992 |

* cited by examiner

APPARATUS FOR IMPARTING STRETCH TO FABRICS

This invention relates to an apparatus for imparting stretch to fabrics and in particular relates to a way of controlling the stretch so imparted.

In our EP patent publication number 0705356 there is described an apparatus for imparting stretch to fabrics which comprises means for applying heat and pressure to a woven fabric, transport means for effecting relative movement between said heat and pressure application means and said fabric whereby passage of the fabric through the apparatus results in the yarn strands substantially across the width of the fabric being forced closer together, thus shrinking the fabric and imparting semi-permanent "ease" or "stretch" into the fabric. The fabric is subsequently fused to an interlining to stabilise the shrinkage and prevent it being lost in subsequent processing. Our EP patent publication no. 1200662 discloses a method of treating synthetic, heat-settable fabrics with this apparatus, and no interlining need be applied.

The fabric is generally in the form of strips, and a number of strips may be processed simultaneously going side by side through the apparatus.

If the strips or tapes have a repeat pattern, for example in the case of jacquard labels, it is very important that the shrinkage be constant so that, when the processed tapes are indexed on conventional 'cut and fold' label producing equipment, the labels will be of a consistent length. Even small variations in shrinkage can render the labels useless since label application equipment, including 'pick and place' systems and automatic type label sewing systems rely on accurately cut and folded labels for their operation. Variations in temperature and pressure of the process as well as processing speed can cause variations in the properties, e.g. degree of shrinkage, of the product so-formed.

The present invention seeks to provide an apparatus having improved control means so as to maintain a constant degree of shrinkage in the fabric treated.

According to a first aspect of the present invention, there is provided an apparatus for the treatment of fabric which comprises:

transport means for effecting relative movement between a heat and pressure application means and the fabric, whereby the passage of the fabric through the apparatus results in the yarns substantially across the width of the fabric being forced closer together, thus imparting semi-permanent "ease" or "stretch" into the fabric, characterised in that downstream fabric speed control means are employed downstream of the apparatus whereby to maintain the fabric output speed at a predetermined level.

The downstream fabric speed control means may comprise any suitable mechanism but preferably comprise nip rollers, which grip the fabric and may be driven at a constant, predetermined speed. This ensures that the fabric output speed is constant also. If upstream fabric speed control means, e.g. nip rollers, are also employed on the input side of the apparatus, the speed difference between the input and output means can be controlled and made constant thus ensuring that the fabric shrinkage is constant also. Preferably, the apparatus further comprises an upstream fabric speed control means employed on the input side of the apparatus upstream of the transport means to maintain the fabric input speed at a predetermined level.

Preferably, the upstream fabric speed control means comprises nip rollers.

The apparatus can comprise speed difference control means for controlling the speed difference between the upstream and downstream fabric speed control means.

To take an example, if 25% shrinkage is required in a particular fabric, the output rollers are set to run at 75% of the speed of the input rollers. The parameters of the apparatus are set to achieve a minimum fabric shrinkage level of 25% and the output rollers effectively stretch any over-shrunk fabric back to this value.

In general terms, the parameters of the apparatus can be altered by varying the temperature, pressure or throughput speed of the process.

In a preferred embodiment of the invention, additional control means is present for detecting under shrinkage. If the latter were to occur, a loop would appear in the tape prior to the output rollers. If this is detected action can be taken to adjust the parameters of the apparatus to correct the fault, i.e. increase the shrinkage of the fabric being treated.

Since the labels are usually synthetic material, e.g. polyester, there is often no need to fuse them to an interlining before subsequent use, but this may be done if desired.

According to a further aspect of the invention, there is provided a method of treatment of fabric comprising the steps of:

providing a heat and pressure application means;

providing a transport means for effecting relative movement between the heat and pressure application means and the fabric;

providing the fabric to the transport means and thereby past the heat and pressure application means, resulting in the yarns substantially across the width of the fabric being forced closer together, thus imparting semi-permanent "ease" or "stretch" into the fabric; and passing the fabric through downstream fabric speed control means to maintain the fabric output speed at a predetermined level.

Preferably, the method further comprises the step of passing the fabric through upstream fabric speed control means to maintain the fabric input speed at a predetermined level prior to providing the fabric to the transport means.

Figure 1:
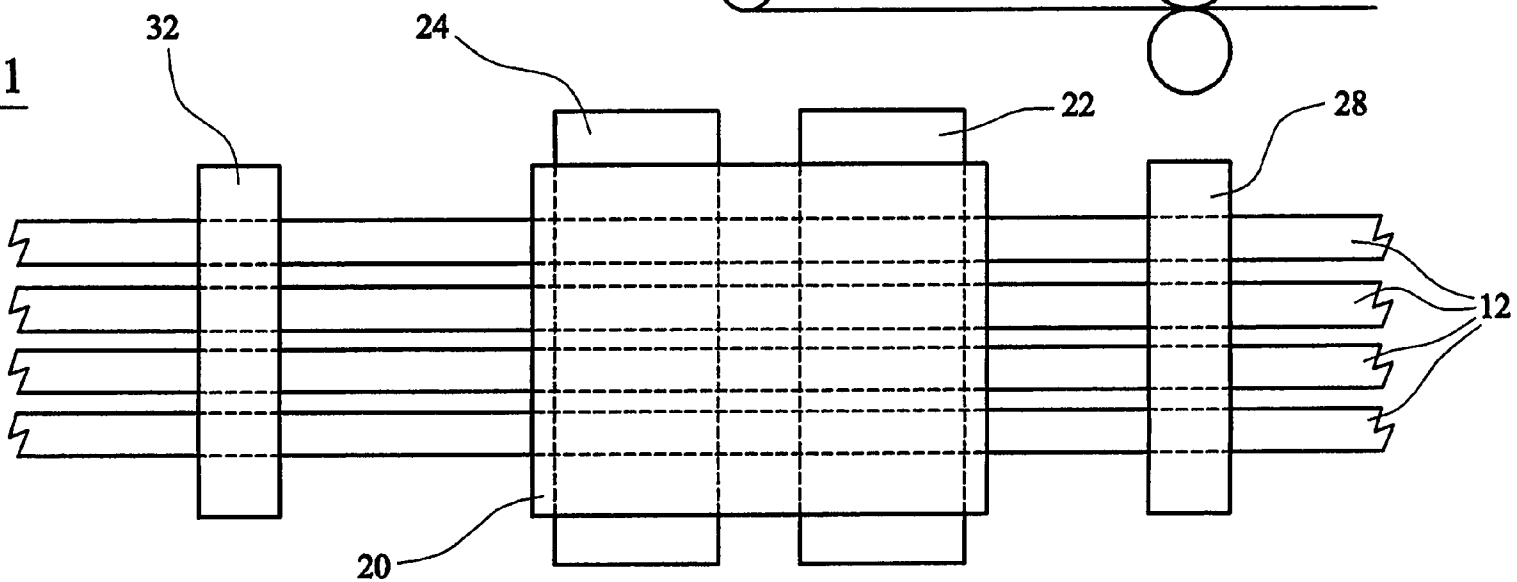

The invention will be described further, by way of example, with reference to the accompanying drawings, in which:

FIG. 1 is a diagrammatic plan view of an apparatus modified in accordance with the invention; and FIG. 2 is a side view corresponding to FIG. 1.

Referring to the drawings, apparatus according to our above mentioned European patent publication number 0705356 B comprises a rubberised conveyor belt (20) driven by conveyor rollers (22,24) and a heated roller (26) which is held against the best (20) in close proximity to roller (24) so as to apply heat and pressure to fabric strips or tapes (12) passing through the nip formed between the rollers (26) and (24). Heated roller (26) and roller (24) therefore constitute heat and pressure application means. The strips (12) are fed onto the conveyor and the fabric strip direction is at right angles to the axis of the heated roller (26). The strips are progressed through the nip of the roller (26) and the conveyor (20) (FIG. 2). The best or conveyor (20) therefore constitutes transport means for effecting relative movement between the heat and pressure application means and the fabric strips (12).

The result of this treatment is to force the strands which pass substantially across the width of the strip to draw closer together, as discussed in our above mentioned European patent publication, shrinking the fabric and imparting stretch to it.

In accordance with the invention, this apparatus is modified by the provision of downstream fabric speed control means in the form of driven output nip rollers (28). As illustrated, an idler roller (30) is employed to accommodate the change in path of the strips (12).

In addition, upstream fabric speed control means, in this case driven nip rollers (32), are also employed on the input side of the apparatus. Thus the speed difference between the input and output means can be controlled and made constant thus ensuring that the fabric shrinkage is constant also.

In operation the input speed is set by adjusting the drive speed of the input rollers (32) and the parameters of the apparatus adjusted (heat and pressure of roller (26)) to give the desired level of shrinkage. The speed of the output rollers (28) can then be calculated and set, ensuring a constant degree of shrinkage in the strips (12) treated. If the strips (12) are strips of labels, their indicia will then line up exactly with subsequent cutting equipment and when cut will be of a consistent length. Such labels may be fused to a further interlining to stabilise the shrinkage, and thus stretch, of the labels which may then be incorporated into garments which themselves have stretch properties without adversely affecting those properties as would be the case if they were non-stretch. Alternatively, where the labels are of a thermoplastic synthetic material, e.g. polyester, the mechanical stretch properties of the processed material may be sufficient such that no further fused interlining will be required.

Thus, in accordance with the invention, stretch labels can be processed and variability in shrinkage may be reduced or eliminated so that they are of consistent length for subsequent processing equipment such as cut and fold label producing equipment.

In an alternative embodiment of the invention, the apparatus comprises speed difference control means for controlling the difference in speed between the upstream and downstream nip rollers.

The invention claimed is:

1. An apparatus for a treatment of a fabric which comprises:

a heat and pressure application means, a transport means for effecting relative movement between the heat and pressure application means and the fabric, whereby passage of the fabric through the apparatus results in yarns substantially across a width of the fabric being forced closer together, thus imparting semi-permanent ease or stretch into the fabrics, an upstream fabric speed control means employed on an input side of the apparatus upstream of the transport means for maintaining a fabric input speed at the predetermined level, and a downstream fabric speed control means employed downstream of the transport means for maintaining a fabric output speed at a predetermined level, wherein parameters of the throughput of the fabric through the upstream and downstream fabric speed control means and heat and pressure of the heat and pressure application means are set to achieve a minimum desired fabric shrinkage consistent with a difference in speed between the upstream and downstream fabric speed control means such that the downstream fabric speed control means stretches any over shrunk fabric back to a desired fabric shrinkage.

2. An apparatus as claimed in claim 1, wherein the downstream fabric speed control means comprises nip rollers.

3. An apparatus as claimed din claim 2, wherein the nip rollers are adapted to be driven at a constant speed.

4. An apparatus as claimed in claim 1, wherein the upstream fabric speed control means comprises nip rollers.

5. An apparatus as claimed in claim 1, further comprising speed difference control means for controlling a speed difference between the upstream and downstream fabric speed control means.

6. An apparatus as claimed in claim 1, further comprising additional control means for detecting undershrinkage.

7. A method of treatment of a fabric comprising the steps of:

providing a heat and pressure application means;

providing a transport means for effecting relative movement between the heat and pressure application means and the fabric;

passing the fabric through upstream fabric speed control means to maintain a fabric input speed at a predetermined level;

providing the fabric to the transport means and thereby past the heat and pressure application means, resulting in yarns substantially across a width of the fabric being forced closer together, thus imparting semi-permanent ease or stretch into the fabric; and passing the fabric through downstream fabric speed control means to maintain a fabric output speed at a predetermined level;

wherein parameters of the throughput of the fabric through the upstream and downstream fabric speed control means and heat and pressure of the heat and pressure application means are set to achieve a minimum desired fabric shrinkage consistent with a difference in speed between the upstream and downstream fabric speed control means such that the downstream fabric speed control means stretches any over shrunk fabric back to a desired fabric shrinkage.

8. A method of treatment of fabrics as claimed in claim 7, wherein the step of passing the fabric through upstream fabric speed control means is performed prior to providing the fabric to the transport means.

9. A method of treatment of fabric as claimed in claim 7, wherein at least one of the upstream and downstream fabric speed control means comprises nip rollers.

10. A method of treatment of a fabric as claimed in claim 7, further including the step of controlling a difference in speed between the upstream and downstream fabric speed control means.

11. A method of treatment of a fabric as claimed in claim 7, further including the step of detecting undershrinkage.

* * * * *